US005573653A

United States Patent [19]

Bandlish

[11] Patent Number: 5,573,653

[45] Date of Patent: Nov. 12, 1996

[54] ELECTROCHEMICAL PROCESS FOR THIOCYANATING AMINOBENZENE COMPOUNDS

[75] Inventor: Baldev K. Bandlish, Charlotte, N.C.

[73] Assignee: Sandoz Ltd., Basel, Switzerland

[21] Appl. No.: 423,175

[22] Filed: Apr. 18, 1995

Related U.S. Application Data

[63] Continuation of Ser. No. 273,255, Jul. 11, 1994, abandoned.

[51] Int. Cl.[6] ..... C25B 3/00

[52] U.S. Cl. ..... 205/413; 205/431; 205/444

[58] Field of Search ..... 204/59 R, 72

[56] References Cited

U.S. PATENT DOCUMENTS 3,431,184 3/1969 Andreades ..... 204/59

FOREIGN PATENT DOCUMENTS 364060 12/1931 United Kingdom ..... 204/72

OTHER PUBLICATIONS

Mel'nikov et al., *J. Gen. Chem.* (U.S.S.R.) 14, 113–15 (1994).

*Organic Reactions,* vol. III, ed. by Adams et al., John Wiley & Sons, Inc., New York (1946), pp. 242–257. no month.

Cauquis et al., *C.R. Acad. Sc. Paris,* t. 266 (1968), pp. 883–886. no month.

Yoshida et al., "Anodic Oxidations (Part VI) Para–Cyanation of Diphenylamines", *J. Org. Chem.,* vol. 37, No. 25, pp. 4145–4147 (Dec. 15, 1972).

Khrishnan et al., "A Two–Phase Electrochemical Method For Thiocyanation", Synth. Commun., 22(19), 2741–4. 1992.

Mel'nikov et al., "Electrochemical Thiocyanation of Organic Compounds. III. p–Substituted Aromatic Amines", *J. Gen. Chem.,* vol. 14 (no month, 1994), pp. 113–115. *Chemical Abstract.*

*Primary Examiner*—Kathryn Gorgos
*Assistant Examiner*—Edna Wong
*Attorney, Agent, or Firm*—Robert S. Honor; Melvyn M. Kassenoff; Diane E. Furman

[57] ABSTRACT

An improved electrochemical process for thiocyanating aminobenzene compounds (e.g., 3,4-dichloroaniline), and in particular a process for preparing 2-aminobenzothiazole compounds, is disclosed which provides attractive yields under relatively favorable temperature conditions, and with reduced or minimal cyanide formation. In a further aspect, use of quaternary ammonium salts in the thiocyanation medium has been found to inhibit cathodic corrosion.

20 Claims, No Drawings

ELECTROCHEMICAL PROCESS FOR THIOCYANATING AMINOBENZENE COMPOUNDS

This is a continuation of application Ser. No. 08/273,255, filed Jul. 11, 1994, now abandoned.

BACKGROUND OF THE INVENTION

A well-established method of thiocyanating aminobenzenes, which typically is carried out as a first step in the synthesis of 2-aminobenzothiazoles, comprises reacting the aminobenzene compound with an alkali metal- or ammoniumthiocyanate in a neutral solvent under bromine- or chlorine-catalyzed oxidizing conditions. The thiocyanation reaction is commonly understood to proceed via oxidation of thiocyanate ion, $SC{=}N^-$, to form a reactive thiocyanogen entity, $(N{=}C{-}S)_2$, the lability of which essentially requires that it be generated in situ in the presence of the aniline compound, see *Organic Reactions,* Vol. III, Adams, R. ed., John Wiley & Sons, Inc., New York (1946), pp. 251–253. However, the halogen and cyanide-contaminated effluent of such chemical thiocyanation processes poses a substantial problem of waste treatment in face of increasingly stringent environmental regulations.

Over the past fifty years or longer, workers in the art have investigated an electrochemical process for thiocyanating aminobenzenes and other organic compounds, see Adams, ed., id. at 253, 257. Such an anodic oxidation process, which dispenses with the requirement of a halogen reagent, potentially meets the need for a more environmentally compatible thiocyanation process.

The approach heretofore in the art, however, to applicant's knowledge, is of limited practicality for industrial purposes. For example, workers in the art have carried out a laboratory electrochemical thiocyanation reaction at temperatures well below the ambient (i.e. down to about −5° to −8° C. and even lower) in order to stabilize the thiocyanogen radical, see, e.g., N. N. Mel'nikov and E. M. Cherkasova, J.Gen. Chem. (U.S.S.R.) 14, 113–115 (1944); but at more favorable reaction temperatures (e.g., 5°–15° C.) under the prior art conditions, hydrogen cyanide has proved to be a significant by-product. Furthermore, in the prior, "low temperature" processes, an ethanol solvent has been employed which is diluted with acid or water to preserve conductivity, to an extent, however, which can affect reactant solubility. Other reported work involving the use of toxic and/or expensive solvents, such as acetonitrile (see C.R. Acad. Sc. Paris, t.266, Mar. 18, 1968, Series C-883), has limited application on a commercial scale.

Moreover, acid corrosion of the cathode in a scaled-up single cell electrochemical thiocyanation process, is a significant operating difficulty which has still to be addressed.

It has therefore been an objective in the art to devise an industrially feasible electrochemical process for thiocyanating aminobenzenes.

It has been a particular objective to achieve a process in which cathodic corrosion is reduced or prevented.

Such a process would provide substantial commercial advantages, for example, from the standpoint of reducing toxic effluent, in a process for thiocyanating aminobenzene compounds, and in an overall process for preparing 2-aminobenzothiazole compounds.

SUMMARY OF THE INVENTION

An improved electrochemical thiocyanation process is disclosed which can provide attractive yields under more favorable temperature conditions, and with low or virtually no hydrogen cyanide generation.

In particular, it has been found that substantial benefits and improvements can be obtained in an electrolytic process for thiocyanating aminobenzene compounds wherein certain critical concentration relationships are satisfied with respect to components of the reaction medium.

The present invention therefore comprises an improved process for thiocyanating aminobenzenes (and in a particular aspect, a process for preparing 2-aminobenzothiazole compounds), which comprises anodically oxidizing an aqueous acidic electrolyte medium comprising the aminobenzene compound, a source of thiocyanate ion, and an alcohol, wherein the concentration of reactants is adjusted such that:

(i) thiocyanate ion, $SC{=}N^-$, is present in the electrolyte medium in an amount such that: (A) there are at least 2.5 moles thiocyanate ion per mole of aminobenzene compound, and (B) thiocyanate ion comprises at least 7% by weight of the electrolyte medium; and (ii) the molar ratio of acid to thiocyanate ion is in the range of about 0.5n:1 to 1.25n:1 where n is the number of equivalents of acid needed to neutralize one mole of thiocyanate ion; and (iii) water concentration is 10 moles of water per kg. of the electrolyte medium or less.

It has been discovered that when the reaction medium is adjusted prior to application of current in the above-indicated manner (and if a subsequent ring closure step is further carried out), an industrially usable (i.e. at least about 80% pure) 2-aminobenzothiazole product can be obtained, and surprisingly, under more favorable temperature conditions than previously employed, and with reduced or minimal hydrogen cyanide formation.

In a further aspect of the invention, it has been found that addition of a quaternary ammonium salt in minor amounts to the reaction medium is effective to inhibit acid-catalyzed corrosion of the cathode.

The 2-aminobenzothiazole compounds which are of principal interest, e.g., 2-amino-5,6(6,7)-dichlorobenzothiazole, find widespread use in the synthesis of chemical intermediates, dyes and photographic chemicals.

DETAILED DESCRIPTION OF THE INVENTION

The process of the process of the invention comprises anodically oxidizing an aminobenzene compound and a source of thiocyanate ion in an aqueous acidic, alcoholic medium.

An advantage of the invention resides in the relatively favorable reaction temperatures which may be employed, with reduced or minimal hydrogen cyanide formation. For example, the reaction medium can be maintained at a temperature in the range of about 0° to 25° C., and preferably about 5° to 25° C. (e.g., 10° to 20° C.), and therefore passing cold water through a jacketed reactor will generally suffice to maintain an appropriate internal temperature, without need for further cooling apparatus.

Suitable sources of thiocyanate ion include alkali metal thiocyanates such as lithium, sodium or potassium thiocyanate, as well as ammonium thiocyanate. Alkali metal thiocyanate compounds, particularly sodium or potassium (most preferably sodium) are preferred over ammonium compounds, which can create a problem of ammonia generation when the reaction medium is neutralized to liberate the product as a free amine from its acid salt.

Suitable starting aminobenzenes may be substituted or unsubstituted. (The term "aminobenzene" as herein employed shall be understood to refer both to aminobenzene (i.e. aniline) per se, as well as to aminobenzene compounds in which the aromatic ring is substituted by one or more substituents.) It will be evident to one skilled in the art that if the thiocyanation process of the invention is carried out to generate intermediates for the synthesis of a 2-aminobenzothiazole compound, then suitable aminobenzene starting materials will therefore be substituted at the 4-(i.e. para) position in order that thiocyanation preferentially take place in the 2- (i.e. ortho) orientation, which is essential for subsequent cyclization. Such para-substituted aminobenzenes may contain additional ring substituents, provided these do not interfere (e.g., sterically) with the formation of the 2-aminobenzothiazole product. Accordingly, examples of suitable starting compounds in the preparation of 2-aminobenzothiazoles may comprise 4-chloroaminobenzene (i.e. 4-chloroaniline), 3,4-dichloroaminobenzene (i.e. 3,4-dichloroaniline), 4-methylaminobenzene (i.e. 4-toluidine), 4-nitroaminobenzene (i.e. 4-nitroaniline), 4-aminobenzoic acid, 4-aminobenzene sulfonic acid, 4-aminobenzene sulfonamide, 4-aminobenzene sulfonate, etc. It will also be appreciated that thiocyanation of an aminobenzene compound wheein the aromatic ring is 3,4-di-substituted, followed by a ring closure step, will result in formation of two substituted 2-aminobenzothiazole position isomers wherein the phenyl ring is substituted at either the 5,6- or 6,7- positions.

For example, thiocyanation of 3,4-dichloroaminobenzene can result in formation of 2-thiocyano-4,5-dichlorobenzenethiourea or 2-thiocyano-3,4-dichlorobenzenthiourea, either of which may be cyclized to yield, respectively, 2-amino-5,6- dichlorobenzothiazole or 2-amino-6,7-dichlorobenzothiazole.

The concentration of the aminobenzene compound in the reaction medium may vary, depending primarily on its solubility in the reaction medium (and provided the conditions of the invention with respect to the other components of the reaction medium are satisfied). On the one hand, very low concentrations of aminobenzenes (i.e. below about 0.1 mole per kg of reaction medium) may result in low yields of thiocyanated product as a result of poor reaction kinetics. Generally, the reaction medium comprises at least about 0.1 mole/kg aminobenzene compound, preferably greater than 0.5 mole/kg., and even higher concentrations. On the other hand, where a substituted aminobenzene compound is employed which has reduced solubility in the reaction medium, its concentration should not be such that undissolved solids accumulate at the electrodes to the extent of impairing current efficiency. It will be within the skill of the worker in the art to select an appropriate concentration of the aminobenzene compound, given the nature of the other reactants, the solubility of the aminobenzene compound in the reaction medium, and other practical limitations.

A preferred acid for use in the electrolyte solution of the invention is hydrochloric acid, especially concentrated hydrochloric acid.

Acid concentration in the reaction medium is such that when current is first applied, at least about 50%, and preferably at least about 90% of thiocyanate ion is neutralized.

In general, the molar ratio of acid to thiocyanate ion will be about 0.5n:1 to 1.25n:1, and preferably about 0.9n:1 to 1.1n:1, and even more preferably about 1n:1, where n is the number of equivalents of acid needed to neutralize one mole of thiocyanate ion; and Thus for example, in the case of hydrochloric acid, one equivalent (i.e. 1 mole) of acid is needed to neutralize one mole of thiocyanate ion, and n therefore has a value of 1 for purposes of the above ratios.

Of course, even concentrated acids, e.g., conc. (i.e. 35%) HCl, will carry as much as 65% and even greater amounts of water into the reaction medium. Therefore, to practice within the bounds of the invention, it is generally desirable that no additional water be added to the reaction medium beyond that which is provided as a component of the added acid or other starting materials.

Suitable alcohols to be employed comprise lower alcohols (e.g., methanol, ethanol, isopropanol, n-propanol, butanol, isobutanol, and t-butanol), of which methanol and ethanol are preferred, and methanol is most preferred.

Preferably the alcohol is provided in sufficient amount to make up the balance of the reaction medium to 100%, after the acid, water, aminobenzene compound and thiocyanate (and any optional) constituents have been combined. The resulting alcoholic medium will comprise thiocyanate ion, acid and water, respectively, in a concentration within the scope of the invention as already defined. In one aspect of the invention, the reaction medium consists essentially of the aminobenzene compound, a source of thiocyanate ion, acid, water, and alcohol, the alcohol providing the balance of the reaction medium to 100% after taking into account the other constituents.

It has further been found that improved yields can be obtained by providing to the reaction medium in minor amounts, a quaternary ammonium salt, in particular certain tetraalkylammonium salts which typically have been employed as phase-transfer catalysts or surface-active agents, notably, cetyltrimethylammonium bromide. While not being bound thereby, it is considered that the tetraalkylammonium salts may deposit as a protective surface layer on the cathode and thereby prevent or minimize acid corrosion. Said tetraalkylammonium salts may be represented by the formula $N^+(R_1)(R_2)(R_3)(R_4)\ X^-$, wherein $R_1$, $R_2$, $R_3$ and $R_4$ are independently selected from $C_{1-25}$alkyl, and $X^-$ is a counterion such as a halide (e.g., $Br^-$, $I^-$, $Cl^-$). For example, each of $R_1$, $R_2$, and $R_3$ may be $C_{1-4}$alkyl, e.g., $C_{1-2}$alkyl, and $R_4$ may be $C_{15}$–$C_{25}$alkyl. Said salts are generally present in the reaction medium in a concentration of about 0.01 to 5, preferably 0.5 to 2, grams per kg. of reaction medium.

The electrolysis can be carried out in a divided electrochemical cell or undivided cell. The undivided cell is preferred unless the reactants or product are susceptible to reduction at the cathode.

The cathode may comprise stainless steel, nickel, and other conventionally useful materials, and is preferably stainless steel.

The anode may also be selected from known materials such as glassy carbon, graphite, etc., and is preferably graphite.

To carry out the thiocyanation reaction of the invention, direct or substantially direct current is applied to the electrodes. A current density of about 1 to 10 amperes per square decimeter (ASD), and more particularly about 4 to 6 ASD has been employed, although higher current densities are possible. Current is applied for a time sufficient to pass the theoretical amount of coulombs required to thiocyanate at least a portion of the aniline starting material. Theoretically, at 100% current efficiency, two moles of electrons (i.e. 2×96,500 coulombs=193,000 coulombs) are consumed in thiocyanating one mole of aniline; at 140% theoretical current, 2.8 moles of electrons would be required. Preferably, to facilitate complete reaction, current is generally applied for a time sufficient to pass about 130–140% of theoretical current.

Without being bound thereby, it is postulated that in the process of the invention, the employment of a reaction medium comprising relatively high thiocyanate ion concentration and relatively low water concentration tends to shift reaction kinetics toward formation of one or more relatively stable forms of the oxidized thiocyanate ion, perhaps substantially in place of, or in addition to, the previously mentioned thiocyanogen entity. Support for such a mechanism is indirectly provided by the substantial absence of polymeric thiocyanogen as a reaction precipitate at the higher operating temperatures employed herein, and still further, by the substantial absence of hydrogen cyanide, which is a degradation product of thiocyanogen.

A plausible reaction mechanism may involve initial dissolution of the thiocyanate ion in the acidic solution to form thiocyanic acid or substituted thiourea, and protonation of the amino group of the aminobenzene compound to form an ammonium group. Thiocyanic acid can therefor be oxidized to thiocyanic acid cation radical, $HSCN^{+\cdot}$, which in turn can react with the aminobenzene or the substituted thiourea to yield a thiocyanated amino benzene compound or thiocyanated benzenethiourea. Where the aromatic ring of the starting aminobenzene compound is para-substituted, thiocyanation will preferentially occur at the ortho position.

Following electrolysis the thiocyanated compounds of the invention can be recovered from the electrolyte solution by conventional means, e.g., neutralization, filtration, etc.

If a 2-aminobenzothiazole product is to be prepared from either o-thiocyanated benzenethiourea or o-thiocyano-substituted aminobenzene, ring closure can be carried out in a secondary step (to the extent not already effected during electrolysis) by heating the reaction medium, e.g., to about 35° to 60° C., and preferably about 40°–45° C. Preferably, the electrolyzed solution is slowly heated to the desired temperature, and is thereafter maintained at the elevated temperature for a period of time sufficient to effect ring closure, usually about 2–4 hours.

The reaction mixture can then be neutralized and brought to pH 8.5 to 10 to liberate the aminobenzothiazole compound as a free amine from the acid salt thereof.

A work-up procedure found to provide good results without the formation of tars comprises preparing a sodium hydroxide solution of pH 8.5–10 at a temperature of about 40°–60° C., gradually adding the reaction medium containing the acid salt of the aminobenzothiazole compound to said sodium hydroxide solution, while at the same time metering to the resulting combined solution sufficient concentrated sodium hydroxide to maintain a fairly constant pH in the combined solution of 8.5 to 10.

Reductions in cyanide ion concentration to as low as 50 ppm or below, or 5 ppm and below, and even lower levels (e.g., 1 ppm or below), have been achieved by the process of the invention.

The product mixture can then be passed to a filtration press, the wet cake containing the product dried, and the filtrate containing any cyanide ions either further treated by conventional means (e.g., peroxide degradation), to remove dissolved cyanide or discarded. Cyanide ions captured in an overhead scrubber can be treated similarly.

Further aspects and embodiments of the invention are illustrated in the following examples, which however are for illustrative purposes only and are not intended in any way to be limitative of the invention.

In the examples, a multipurpose undivided flow cell equipped with a 100 $cm^2$ stainless steel cathode, a 100 $cm^2$ graphite anode, a DC power supply, coulometer, 100 A shunt, glass reservoir, Haake Circulator, cooling bath, chiller, filtration equipment, and overhead scrubber, is employed for electrolysis.

(a) Thiocyanation of 3,4-dichloroaminobenzene [i.e. 3,4-dichloroaniline (DCA)]: In each of the examples, an electrolyte solution was prepared by combining in the following order, with stirring: an alcohol, comprising either methanol or ethanol; 3,4-dichloroaminobenzene; a source of thiocyanate ion, comprising either sodium or ammonium thiocyanate; optionally, cetyl trimethylammonium bromide; and concentrated hydrochloric acid.

(Examples 1–8, 17–18 and Comparative Examples 9–12 and 16 utilized methanol solvent. Comparative Examples 13–15 employed ethanol solvent. In all of the examples except Example 2, sodium thiocyanate was employed as the source of thiocyanate.)

Columns (i)–(v) on the following Tables I–III respectively indicate the concentration (in either moles or grams of reactant per kg. of reaction medium) of water, 3,4-dichloroaminobenzene [i.e. dichloroaniline (DCA)], thiocyanate ion, hydrochloric acid, and cetyltrimethylammonium bromide (CTAB) additive in the reaction medium at the start of reaction. The water content of the electrolyte [col. (i)] is derived from the added HCl. HCl concentration is indicated separately [col. (iv)] on a 100% basis.

The solution was transferred to the MP cell, and cooled to 10° C. The solution was electrolyzed at a current density of 5 ASD and at the internal temperature indicated in column (viii) of Tables I–III, until 140% of theoretical current was passed.

(b) 2-amino-S,6(6,7)-dichlorobenzothiazole.

Following electrolysis, the electrolyte solution was gradually heated to 40°–45° C. over a period of about 2 hours, and then the temperature was held at about 45° C. for an additional two hours.

(c) After heating, the electrolyte solution was poured slowly over a period of about one hour into a 5-liter three-neck round bottom flask containing approximately 2,250 g. of sodium hydroxide solution at pH 8.5 to 10. At the same time, concentrated sodium hydroxide was added as needed to the flask to maintain a final pH of 8.5 to 10 in the resulting diluted product solution. The solution was passed to a filtration press, and the recovered tan-colored wet cake containing 2-amino-5,6(6,7)-dichloro-benzothiazole was washed with warm water and dried.

The % yield of 2-amino-5,6(6,7)-dichlorobenzothiazole (ADCBTZ) is given in column (ix); and the % conversion of 3,4-dichloroaminobenzene is indicated in column (x) of the following Tables I–III.

Cyanide ion concentration in the filtrate or scrubber was determined by ion chromatography, and is indicated in columns (vi) and (vii), respectively.

Examples 1–8 (Table I) illustrate that as a result of carrying out a thiocyanation process according to the teachings herein, followed by a ring closure step, attractive yields of 2-aminobenzothiazole may be obtained under the more favorable temperature conditions of the invention, and typically with very low hydrogen cyanide formation.

In the reactions of Comparative Examples 9–12 (Table II), the water and acid concentrations are outside the scope of the invention. In the reactions of Comparative Examples 13–16, Table II), acid concentration is outside the scope of the invention. The Comparative Examples demonstrate that reduced yields and higher cyanide formation can result from practicing outside the scope of the invention.

Additionally, the Examples demonstrate that when practicing within the scope of the invention, i.e. within the concentration parameters set forth herein, the percent conversion of the aminobenzene starting material and percent yield of the 2-aminobenzothiazole product were within at most about 25% of each other, and frequently within about 15% or less (e.g., about 3–5%) of each other; and therefore, an industrially usable 2-aminobenzothiazole product can be obtained by passing more current and/or by raising current efficiency in certain cases. By contrast, the Comparative Examples indicate that when practicing outside the scope of the invention in one or more critical aspects (e.g., excess acid and/or water concentration), there can result a considerable disparity between % DCA conversion and % ADCBTZ yield, which in the instant case was as high as about 60–70% and was typically in the range of about 35 to 40%; and therefore, passing more current or improving current efficiency in such cases will not likely improve yield to the extent of providing an industrially usable 2-aminobenzothiazole product.

In the reactions of Examples 17 and 18 (Table III), identical reactant concentrations were employed which are within the scope of the invention. However, in Example 18, the thiocyanation process was carried out according to a preferred embodiment of the invention, i.e. in the presence of a quaternary ammonium salt, namely, cetyltrimethylammonium bromide, in the indicated amount in grams per kg. of reaction medium (column vi). CTAB was not present in the reaction of Example 17. In these examples, cathode corrosion was determined by measuring the weight of the cathode prior to and after electrolysis. Weight loss is indicated in grams per pound of 2-amino-5,6(6,7)-dichloroaminobenzothiazole which was produced (col. xi). Examples 17 and 18 demonstrate that enhanced resistance to cathodic corrosion can be achieved by providing to the reaction medium a minor amount of a quaternary ammonium salt.

TABLE I

| | | | | | | $CN^-$ | | | ADCBTZ[3] | DCA |
|---|---|---|---|---|---|---|---|---|---|---|
| | $H_2O$ moles/Kg (i) | DCA[1] moles/Kg (ii) | SCN— moles/Kg (iii) | HCl moles/Kg (iv) | CTAB[2] (g/Kg) (v) | filtrate (ppm) (vi) | scrubber (ppm) (vii) | Temp. (°C.) (viii) | Yield[4] (%) (ix) | Conv.[5] (%) (x) |
| Example | | | | | | | | | | |
| 1 | 6.26 | 0.73 | 1.83 | 1.77 | 1 | <1 | — | 15 | 81.2 | 96.7 |
| 2 | 6.15 | 0.72 | 1.91 | 1.75 | 0 | <1 | — | 15 | 67.4 | 89.1 |
| 3 | 6.26 | 0.37 | 1.83 | 1.77 | 1 | <2 | — | 15 | 75.5 | 91.8 |
| 4 | 6.26 | 0.18 | 1.83 | 1.77 | 1 | <2 | — | 15 | 50.8 | 64.7 |
| 5 | 3.13 | 0.37 | 0.92 | 0.885 | 1 | <2 | — | 15 | 45.4 | 55.8 |
| 6 | 6.07 | 0.71 | 1.75 | 1.72 | 1 | 1 | — | 24 | 54.7 | 59.7 |
| 7 | 7.83 | 0.37 | 1.83 | 2.22 | 1 | 12.5 | — | 15 | 56.6 | 79.0 |
| 8 | 4.7 | 0.37 | 1.83 | 1.33 | 1 | 16.8 | — | 15 | 64.9 | 67.9 |

TABLE II

| | | | | | | $CN^-$ | | | ADCBTZ[3] | DCA |
|---|---|---|---|---|---|---|---|---|---|---|
| | $H_2O$ moles/Kg (i) | DCA[1] moles/Kg (ii) | SCN— moles/Kg (iii) | HCl moles/Kg (iv) | CTAB[2] (g/Kg) (v) | filtrate (ppm) (vi) | scrubber (ppm) (vii) | Temp. (°C.) (viii) | Yield[4] (%) (ix) | Conv.[5] (%) (x) |
| Comparative Example | | | | | | | | | | |
| 9 | 6.26 | 0.37 | 0.98 | 1.77 | 0 | — | — | 15 | 35.3 | 72.0 |
| 10 | 10.96 | 0.37 | 1.83 | 3.10 | 1 | 4 | — | 15 | 36.32 | 79.7 |
| 11 | 3.88 | 0.37 | 1.83 | 0.44 | 1 | 29.2 | — | 15 | 34.72 | 75.0 |
| 12 | 10.96 | 0.37 | 1.83 | 1.77 | 1 | 11 to 12 | — | 15 | 51.45 | 85.8 |
| 13 | 16.7 | 0.37 | 1.05 | 1.81 | 0 | <5 | 56 | 8 | 26.5 | 68.1 |
| 14 | 16.7 | 0.37 | 1.05 | 1.81 | 0 | 33 | 35 | 8 | 8.3 | 66.4 |
| 15 | 6.4 | 0.37 | 1.00 | 1.82 | 0 | — | 71 | 8 | 6.4 | 76.1 |
| 16 | 6.6 | 0.37 | 1.02 | 1.86 | 0 | — | — | 8 | 35.3 | 72.0 |

TABLE III

| | | | | | | $CN^-$ | | | ADCBTZ[3] | DCA | Corrosion |
|---|---|---|---|---|---|---|---|---|---|---|---|
| | $H_2O$ moles/Kg (i) | DCA[1] moles/Kg (ii) | SCN— moles/Kg (iii) | HCl moles/Kg (iv) | CTAB[2] (g/Kg) (v) | filtrate (ppm) (vi) | scrubber (ppm) (vii) | Temp. (°C.) (viii) | Yield[4] (%) (ix) | Conv.[5] (%) (x) | (g/lb. ADCBTZ) (xi) |
| Example | | | | | | | | | | | |
| 17 | 6.4 | 0.75 | 1.85 | 1.80 | 2.5 | — | — | 10 | 85.4 | 99.5 | 0.00 |

TABLE III-continued

| | $H_2O$ moles/Kg (i) | DCA[1] moles/Kg (ii) | SCN— moles/Kg (iii) | HCl moles/Kg (iv) | CTAB[2] (g/Kg) (v) | $CN^-$ filtrate (ppm) (vi) | $CN^-$ scrubber (ppm) (vii) | Temp. (°C.) (viii) | ADCBTZ[3] Yield[4] (%) (ix) | DCA Conv.[5] (%) (x) | Corrosion (g/lb. ADCBTZ) (xi) |
|---|---|---|---|---|---|---|---|---|---|---|---|
| 18 | 6.4 | 0.75 | 1.85 | 1.80 | 0 | <1 | — | 10 | 83.6 | 95.3 | 0.276 |

[1]3,4-dichloroaniline
[2]cetyltrimethylammonium bromide
[3]ADCBTZ = 2-amino-3,4-dichlorobenzothiazole
[4]% yield ADCBTZ calculated as: (actual amount of ADCBTZ/thereotical ADCBTZ) × 100
[5]% conversion ADCBTZ calculated as: [(amount DCA started - amount DCA after reaction)/amount DCA started] × 100

What is claimed is:

1. An electrochemical process for thiocyanating an aminobenzene compound which comprises subjecting to direct current at the anode of an electrolytic cell, at a temperature of about 10° to 25° C., an aqueous acidic electrolyte medium comprising the aminobenzene compound, a source of thiocyanate ion, and an alcohol, wherein said electrolyte medium is adjusted such that:

(i) thiocyanate ion, is present in the electrolyte medium in an amount such that (A) there are at least 2.5 moles of thiocyanate ion per mole of aminobenzene compound, and (B) thiocyanate ion comprises at least 7% by weight of the electrolyte medium; and (ii) acid concentration in moles per kg. of electrolyte medium is 0.5 n–1.25n where n is the number of equivalents of acid needed to neutralize one mole of thiocyanate ion; and (iii) water concentration is no greater than 10 moles of water per kg. of electrolyte medium.

2. A process according to claim 1 wherein the aminobenzene compound contains a ring substituent para to the amino group.

3. A process according to claim 2 wherein the aminobenzene compound is 3,4-dichloroaminobenzene.

4. A process according to claim 3 wherein the alcohol is selected from the group consisting of methanol and ethanol, and mixtures thereof.

5. A process according to claim 1 wherein the source of thiocyanate ion is selected from the group consisting of alkali metal and ammonium thiocyanates.

6. A process according to claim 3 wherein the source of thiocyanate ion comprises alkali metal thiocyanates.

7. A process according to claim 1 wherein the electrolyte medium additionally comprises a quaternary ammonium salt.

8. A process according to claim 7 wherein the quaternary ammonium salt has the formula $N^+(R_1)(R_2)(R_3)(R_4)\ X^-$, where $R_1$, $R_2$, $R_3$ and $R_4$ are independently selected from $C_{1-25}$alkyl, and $X^-$ is a counterion.

9. A process according to claim 8 wherein the quaternary salt comprises cetyltrimethylammonium bromide.

10. A process according to claim 1 which comprises the additional step of heating the medium to a temperature sufficient to result in formation of a 2-aminobenzothiazole compound.

11. A process according to claim 1 wherein the temperature is 10° to 20° C.

12. An electrochemical process for preparing a 2-aminobenzothiazole compound which comprises:

(a) subjecting to direct current at the anode of an electrolytic cell, at a temperature of about 10° to 25° C., an aqueous acidic electrolyte medium comprising an aminobenzene compound which contains a ring substituent para to the amino group, a source of thiocyanate ion, and an alcohol, to result in formation of an orthothiocyano-substituted benzenethiourea compound, wherein the electrolyte medium is adjusted such that:

(i) thiocyanate ion is present in the electrolyte medium in an amount such that (A) there are at least 2.5 moles thiocyanate ion per mole of aminobenzene compound, and (B) thiocyanate ion comprises at least 7% by weight of the electrolyte medium; and (ii) acid concentration in moles per kg. of electrolyte medium is 0.5 n–1.25n where n is the number of equivalents of acid needed to neutralize one mole of thiocyanate ion; and (iii) water concentration is no greater than 10 moles of water per kg. of electrolyte medium; and (b) heating the medium to a temperature sufficient to effect formation of a 2-aminobenzothiazole compound.

13. A process according to claim 12 wherein the aminobenzene compound is 3,4-dichloroaminobenzene.

14. A process according to claim 13 wherein the source of thiocyanate ion is selected from the group consisting of alkali metal and ammonium thiocyanates.

15. A process according to claim 14 wherein the source of thiocyanate ion comprises an alkali metal thiocyanate.

16. A process according to claim 14 wherein the alcohol is selected from methanol and ethanol.

17. A process according to claim 12 wherein the electrolyte medium additionally comprises a quaternary ammonium salt.

18. A process according to claim 17 wherein the quaternary ammonium salt has the formula $N^+(R_1)(R_2)(R_3)(R_4)\ X^-$ where $R_1$, $R_2$, $R_3$ and $R_4$ are independently selected from $C_{1-25}$alkyl and $X^-$ is a counterion.

19. A process according to claim 17 wherein the quaternary salt comprises cetyltrimethylammonium bromide.

20. A process according to claim 12 wherein the temperature in step (a) is 10° to 20° C.

* * * * *